United States Patent [19]

Memmel, Jr. et al.

[11] Patent Number: 4,820,375

[45] Date of Patent: Apr. 11, 1989

[54] SCREW TYPE ROD FEEDING AND PLACEMENT MECHANISM

[75] Inventors: Robert A. Memmel, Jr., Clearwater; Daryl A. Wilfong, Palm Harbor; George A. Collins, St. Petersburg, all of Fla.

[73] Assignee: Condes Corporation, Largo, Fla.

[21] Appl. No.: 121,789

[22] Filed: Nov. 16, 1987

[51] Int. Cl.[4] ..... B65B 15/00

[52] U.S. Cl. ..... 156/566; 156/362; 156/475; 198/690.1; 198/663; 221/212

[58] Field of Search ..... 156/464, 475, 552, 558, 156/566, 362; 221/211, 212, 217, 222, 226, 231; 414/129; 198/467.1, 545, 548, 679, 690.1, 803.6, 805, 625, 663

[56] References Cited

U.S. PATENT DOCUMENTS

| | | | |
|---|---|---|---|
| 1,640,907 | 8/1927 | Roderburg | 198/625 |
| 3,126,309 | 3/1964 | Manas et al. | 156/566 |
| 3,700,528 | 10/1972 | Kidd | 156/475 |
| 3,941,242 | 3/1976 | Braden | 198/690.1 X |
| 4,080,731 | 3/1978 | Hammond et al. | 198/548 X |
| 4,238,273 | 12/1980 | Memmel | 156/475 X |
| 4,625,499 | 12/1986 | Yamaguchi et al. | 198/663 |
| 4,660,708 | 4/1987 | Willerding | 198/467.1 X |

FOREIGN PATENT DOCUMENTS

| | | | |
|---|---|---|---|
| 77669 | 9/1918 | Fed. Rep. of Germany | 198/663 |
| 882074 | 7/1953 | Fed. Rep. of Germany | 198/690.1 |

*Primary Examiner*—Michael W. Ball
*Assistant Examiner*—Steven D. Maki
*Attorney, Agent, or Firm*—James E. Nilles; Thomas F. Kirby

[57] ABSTRACT

A rod feeding and placement mechanism for use in apparatus for making hanging file folders comprises a magazine wherein a plurality of flat, elongated, metal rods are vertically stacked, one above another. A pair of laterally spaced-apart, horizontally disposed, slightly convergent, contra-rotating de-stacking screws located below the magazine engage the lowermost rod in the stack and advance or feed it laterally along a rod-path. Another pair of laterally spaced-apart, horizontally disposed contra-rotating top screws above the de-stacking screws then receive the rod from the de-stacking screws and advance or feed it further along the rod-path to an at-rest position located above a flat paperboard blank. Guide rails and magnetic strips support the rod as it advances along the rod-path. The rod is releasably maintained for a moment in the at-rest position by permanent magnets. An air-driven reciprocably movable placement member initially located above the at-rest position is then moved downwardly to engage a rod in the at-rest position and to move it downward to a specific location below the at-rest position, i.e., onto a glue strip along the edge of a stationary blank being fabricated into hanging file folders. The placement member has a port on the surface thereof which confronts the rod. The port is vacuumized as the placement member moves downward so as to hold the rod and prevent it from falling after it is disengaged from the permanent magnets. Just prior to upward reciprocal movement of the placement member, the ports are pressurized to release the rod from the placement member.

18 Claims, 7 Drawing Sheets

SCREW TYPE ROD FEEDING AND PLACEMENT MECHANISM

BACKGROUND OF THE INVENTION

1. Field of Use

This invention relates generally to an improved rod feeding and placement mechanism for successively feeding rods from a stack and for placing each rod at the same specific location.

The improved mechanism, which has other uses, is especially well-suited for use in apparatus for making hanging file folders to feed a rod from a magazine containing a stack of rods and to place the rod at a specific location on a glue strip on a paperboard blank which is momentarily stopped adjacent the mechanism.

2. Description of the Prior Art

U.S. Pat. No. 4,238,273, which is assigned to the same assignee as the present application, discloses apparatus for making hanging file folders of a type wherein elongated support rods (metal or plastic) are attached by gluing and entrapment to the opposite upper edges of a folded, vertically hanging, paperboard blank. Such apparatus generally comprises conveyor means for moving a series of unfolded, flat paperboard blanks along a path of conveyance, each blank having glue patterns provided along opposite edges thereof; a pair of prior art rod feeding and placement mechanisms located on opposite sides of the path of conveyance; and means for momentarily stopping each blank between the pair of mechanisms so that a rod can be applied to each glue pattern.

Each such prior art rod feeding and placement mechanism comprises a rod-dispensing magazine wherein a plurality of rods are disposed in a vertical stack and a rod transfer mechanism operable to remove the lowermost rod from the stack and to place it on a glue pattern on the blank. The rod transfer mechanism comprises two components, namely: a horizontally and reciprocably movable rod-holding plate having a rod-receiving groove therein for receiving the lwwermost rod in the stack and for moving it away from the magazine, and a vertically and reciprocably movable rod applicator for lifting the rod from the groove and for lowering it onto the glue pattern. The rod-receiving groove and the rod applicator each have ports which can be alternately vacuumized to securely hold the rod in the groove or on the rod while being moved therey. The ports, when pressurized, effect release of the rod.

SUMMARY OF THE PRESENT INVENTION

The present invention provides an improved screw type rod feeding and placement mechanism for feeding and placing a rod in a specific location. The improved mechanism comprises means for supporting a plurality of elongated rods in a stack; screw means for releasably engaging the endmost rod at one end of the stack, for advancing it laterally along a rod-path and for releasing it at an at-rest position spaced from the aforesaid specific location; means for releasably maintaining the rod in the at-rest position; and rod placement means for moving the rod from the at-rest position to the aforesaid specific location.

The screw means comprises at least one de-stacking screw which extends from the said one end of the stack toward the at-rest position. The de-stacking screw is rotatable to engage the endmost rod in the stack, to advance it along the rod-path toward the at-rest position and then to release it. The screw means further comprises a second screw extending from the destacking screw toward the at-rest position. The second screw is rotatable to engage the rod being advanced by the de-stacking screw, to further advance it along the rod-path to the at-rest position and then to release it. The de-stacking screw comprises a rotatable body having an axis of rotation and a helical thread around the body, and the axis of rotation of the destacking screw is disposed so that the helical thread thereon tangentially engages a rod being advanced by the de-stacking screw.

Guide means are provided for supporting the rods as they are being advanced toward the at-rest position by the screw means. The rod is made of magnetizable metal and the guide means comprises slotted guide rails and upwardly and downwardly facing magnetic surfaces.

The means for releasably maintaining the rod in the at-rest position also comprises magnetic means near the at-rest position, particularly, a portion of the downwardly facing magnetic surfaces.

The rod placement means for moving the rod from the at-rest position to the said specific location comprises a movable placement member which is engageable with the rod and is reciprocably movable by a pneumatic actuator between a position spaced from the at-rest position and the specific location. The placement member has a vacuum/pressure port for releasably engaging the rod while it is being moved thereby.

In a preferred embodiment, the screw means comprises a pair of laterally spaced apart contra-rotatable de-stacking screws and a pair of laterally spaced-apart contra-rotatable second screws. The axes of rotation of the pair of de-stacking screws converge when proceeding in the direction from the stack toward the at-rest position so that the helical threads thereon tangentially engage a rod being advanced by the pair of de-stacking screws.

The improved screw type rod feeding and placement mechanism is disclosed herein as part of apparatus for making hanging file folders of a type wherein elongated support rods (metal or plastic) are attached by gluing and entrapment to the opposite upper edges of a folded, vertically hanging, paperboard blank. Such apparatus generally comprises conveyor means for moving a series of unfolded, flat paperboard blanks along a path of conveyance, each blank having glue patterns provided along opposite edges thereof; a pair of screw type rod feeding and placement mechanisms located on opposite sides of the path of conveyance; and means for momentarily stopping each blank between the pair of mechanisms so that a rod can be applied to each glue pattern.

Means are provided to synchronize, coordinate and time the operations of the conveyor means, the means for interrupting blank movement, and the screw type rod feeding and placement mechanism.

The improved mechanism offers several advantages over the prior art. For example, it can effect placement of rods at a specific location at speeds of up to 600 units per minute. It effects accurate, dependable feeding and placement of the rods upon glue patterns on paperboard blanks at production speeds which are on the order of 40 per cent higher than prior art speeds of about 175 units per minute.

Tangential contact of the de-stacking screws with the rear edge of the rods effects smooth and uniform rod advancement. The use of slotted guide rails in conjunction with magnetic strips to guide the rods being advanced ensures controlled advancement of the rod and enables precise and accurate placement of each rod in the at-rest position. A portion of the magnetic strips which guide the rods also serve as the means for releasably maintaining a rod in the at-rest position. Although the mechanism is disclosed as removing rods from a vertical stack and moving them along a horizontal path to an at-rest position from whence they are moved vertically downward to a specific location, the mechanism is adaptable for operation in other orientations.

These and other objects and advantages of the present invention will appear hereinafter.

DRAWINGS

DESCRIPTION OF A PREFERRED EMBODIMENT

General Arrangement

Figure 1:
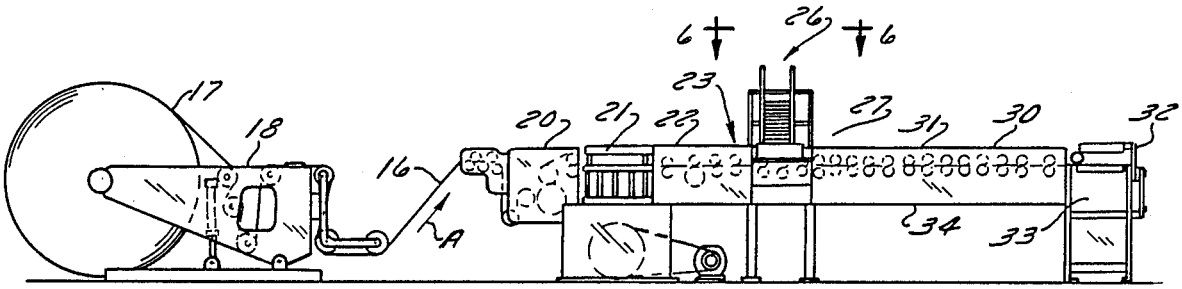
FIG. 1 is a side elevation view of apparatus for making hanging file folders and having two (only one visible) screw type rod feeding and placement mechanisms in accordance with the invention.
Figure 2:
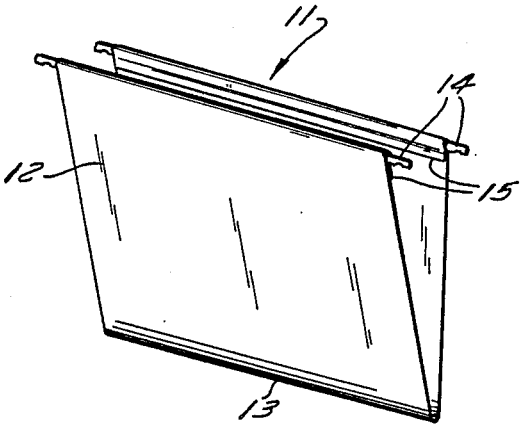
FIG. 2 is an enlarged perspective view of a finished hanging file folder of a type manufactured by the apparatus of FIG. 1 and showing it to comprise a folded paperboard blank and a pair of support rods affixed thereto.

FIG. 1 shows apparatus 10 for making a hanging file folder 11 of the type shown in FIG. 2. Folder 11 comprises a paperboard blank 12, folded along a bottom fold line 13, and having a pair of flat elongated notched metal or plastic support rods 14 glued within over-folded upper edge portions 15 of the blank. The apparatus receives and operates upon a continuous web 16 of paperboard which is supplied from a roll 17 which is supported on a web supply mechanism 18.

Figure 3:
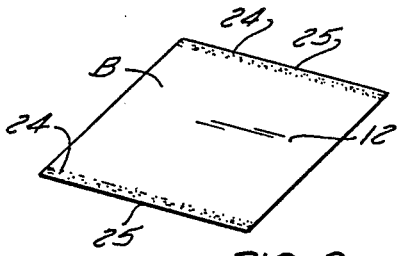
FIGS. 3, 4 and 5 are perspective views showing the file folders of FIG. 2 during various stages of manufacture.

Generally considered, apparatus 10 includes the following mechanisms which perform the following operations on incoming web 16. A web feed mechanism 20 at the input end of machine 10 continuously feeds web 16 thereinto in the direction of arrow A. A blank cutting mechanism 21 successively cuts individual unfolded blanks 12 from the incoming web 16. A first or infeed conveyor mechanism 22 moves the blanks 12 into a first glue applicator mechanism 23 wherein first glue lines or glue patterns 24 are applied to each blank adjacent the opposite longitudinal edges 25 of a blank (see FIG. 3), which edges, when folded, correspond to the upper edge portions 15 (see FIG. 2) of the finished folder 11.

Figure 4:
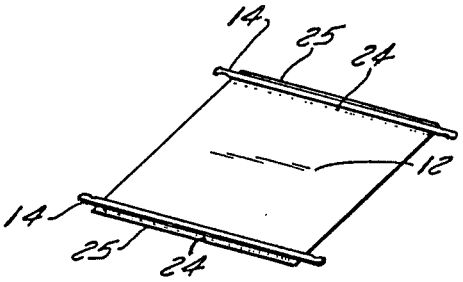

A pair of rod screw type rod feeding and placement mechanisms 26 and 26A in accordance with the invention operate on the blanks 12 with the first glue lines 24 thereon by applying rods 14 on each first glue line 24 (see FIG. 4), and then the blanks 12 with the rods 14 thereon move to a second glue applicator mechanism 27 for further processing and finishing.

Figure 5:
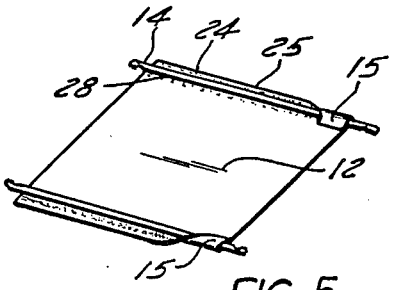

In mechanism 27, second glue lines or glue patterns 28 are applied to each blank adjacent, parallel and inboard of the first glue lines 24 on the rods 14 thereon. Another conveyor mechanism 30 moves the blanks 12 with the second glue lines 28 thereon to an edge-folding mechanism 31 which edge folds the blanks 12 (see FIG. 5) to encapsulate the rods 14 and presses the folded edges 25 into contact with the second glue lines 28. Conveyor mechanism 30 then moves the blanks 12, with edges folded, glued, and rods 14 secured, to a blank folding mechanism 32 wherein the bottom fold-line 13 (FIG. 2) is provided, and from thence to a file folder stacking mechanism 33 from whence the finished folders 11 are removed from machine 10 by suitable means (not shown). The apparatus includes a suitable supporting framework or structure 34 on which all mechanisms are mounted, and such structure may be incorporated in some mechanisms. All component mechanisms of apparatus 10, except the mechanisms 26 and 26A hereinafter described in detail, may take the form of mechanisms known in the prior art.

As FIGS. 6, 7, 8, 10 and 11 show, the mechanisms 26 and 26A in accordance with the invention have disposed therebetween a blank conveyor means 40 for moving a blank 12 therebetween along path P1. A mechanism is provided for momentarily interrupting or stopping movement of the blank. Each mechanism 26 and 26A embodies a rod holding and dispensing magazines 41 in which rods 14 are stored prior to application to the blank and operates to remove a rod from the magazine and apply it to a first glue line 24 on the blank while motion of the blank is stopped. Drive means and control means are provided whereby component parts of mechanisms 26 and 26A are driven and operated in synchronism.

Since the mechanisms 26 and 26A are disposed, only one mechanism 26 is hereinafter described in detail.

Reference should be had to U.S. Pat. No. 4,238,273, hereinbefore referred to, for a complete description of apparatus of a type with which the rod feeding and placement mechanisms 26 and 26A are usable.

Screw Type Rod Feeding and Placement Mechanism

Referring to FIGS. 6 through 11, improved screw type rod feeding and placement mechanism 26 generally comprises a rigid support structure 45, hereinafter described, on which are mounted: a magazine 41 wherein a plurality of rods 14 are vertically stacked, a pair of bottom or de-stacking screws 43 and 44 for removing the lowermost rod from the stack in the magazine and moving or advancing it horizontally along a path P2 (FIG. 6) toward the stationary blank 12 on path P1, a pair of top screws 53 and 54 for receiving the rod being moved by the de-stacking screws and for moving or advancing it horizontally further along path P2 to an at-rest position above a glue strip 24 on stationary blank 12, rod guide means 60 for guiding the rod being advanced along path P2, and rod placement means 70 for releasably receiving a rod when it has reached the at-rest position and for moving the rod downwardly along a vertical path P3 (FIGS. 9 and 10) into engagement with a glue strip 24 on the blank 12 and for then releasing the rod, and means for driving or operating the screw 43, 44 and 53, 54 and placement means 70 in synchronism.

Support Structure

Referring to FIGS. 7, 8, 9 and 10, the support structure 45 is designed and constructed so that the components of mechanism 26 operate to maintain and/or move each rod 14 in a certain relationship to the appropriate glue strip 24 of blank 12 to which the rod is to be attached. Support structure 45, which is rigid and fabricated of metal, generally comprises a horizontal base plate 45A, a vertical back plate 45B, intermediate stack guide plates 47 and 48 extending vertically upwardly from the base plate, a pair of lateral side plate assemblies 45D, and a front plate 45E. Various support brackets, hereinafter identified, are connected at appropriate locations on the support structure. Thus, when a blank 12 is stopped in the position shown in FIGS. 6, 8, 9 and 10, the blank is disposed in a horizontal plane and the glue strip 24 is parallel and adjacent to the edge portion 25 of the blank and is on the upper surface of the blank. Furthermore, the lower most rod 14 in magazine 41 is disposed in a horizontal plane which lies above and is parallel to the plane in which blank 12 lies. The lowermost rod 14 in magazine 41 is disposed so that its longitudinal axis and its rear edge 14B (FIGS. 6 and 11) are parallel to blank edge portion 24 and glue strip 24. As a rod 14 advances laterally along path P2 from magazine 41 to the at-rest position, it remains parallel to blank edge portion 24. The placement means 70 operates to move a rod 14 vertically downwardly along path P3 while maintaining it parallel to blank edge portion 24.

Magazine

Figure 11:
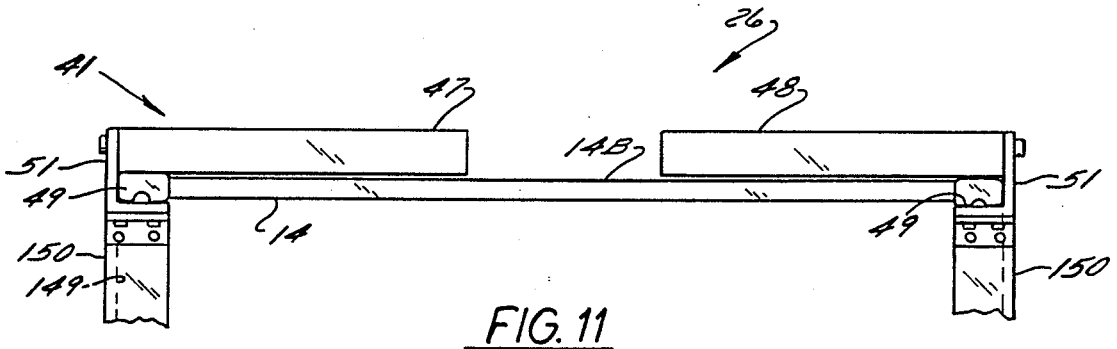
FIG. 11 is a top plan view taken on line 11—11 of FIG. 10.
Figure 12:
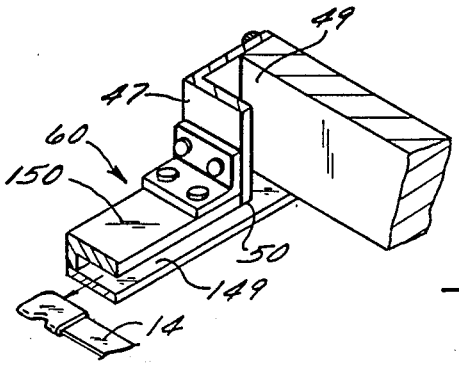
FIG. 12 is an enlarged perspective view of a detail of a guide rail shown in FIGS. 7 and 10.

Referring to FIGS. 6, 8, 9, 10, 11 and 12, magazine 41 comprises a pair of vertical stack guides 47 and 48 which are rigidly secured to base plate 45A of support structure 45 and extend vertically upwardly. The pair of vertical guides 47 and 48 are laterally spaced apart from each other in the direction of path P1. Each vertical guide 47 and 48 has an L-shaped angle-iron 51 affixed thereto which defines a vertically extending slot 49 (FIGS. 6, 10 and 11) at the side thereof which faces or confronts the other slot 49. The vertical slots 49 receive the opposite ends of a rod 14. As FIG. 12 shows, slot 49 has an opening 50 at the lower end thereof on the front side of its vertical guide 47 or 48. The openings 49 enable the lowermost rod 14 in the stack in magazine 41 to be drawn forward from the vertical guides 47 and 48 for movement along path P2 by the de-stacking screws 43 and 44, as hereinafter described. Rod guide means 60, hereinafter described, at the lower ends of the vertical slots 49 just below the openings 50 support the lowermost rod 14 in the stack in alignment with the openings 50.

Bottom or De-stacking Screws

Figure 6:
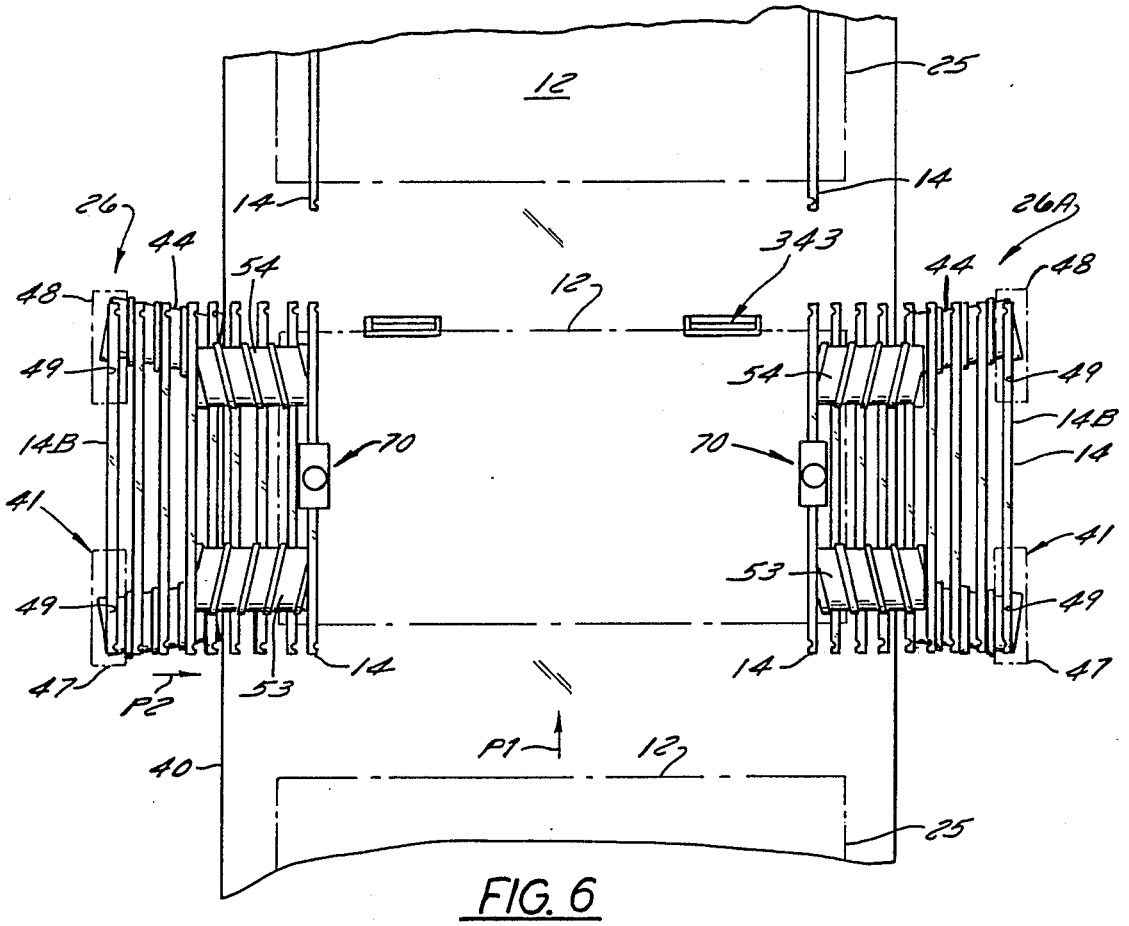
FIG. 6 is an enlarged top plan view taken on line 6—6 of FIG. 1 and showing the relationship of portions of the two screw type rod feeding and placement mechanisms to paperboard blanks moving therepast.
Figure 7:
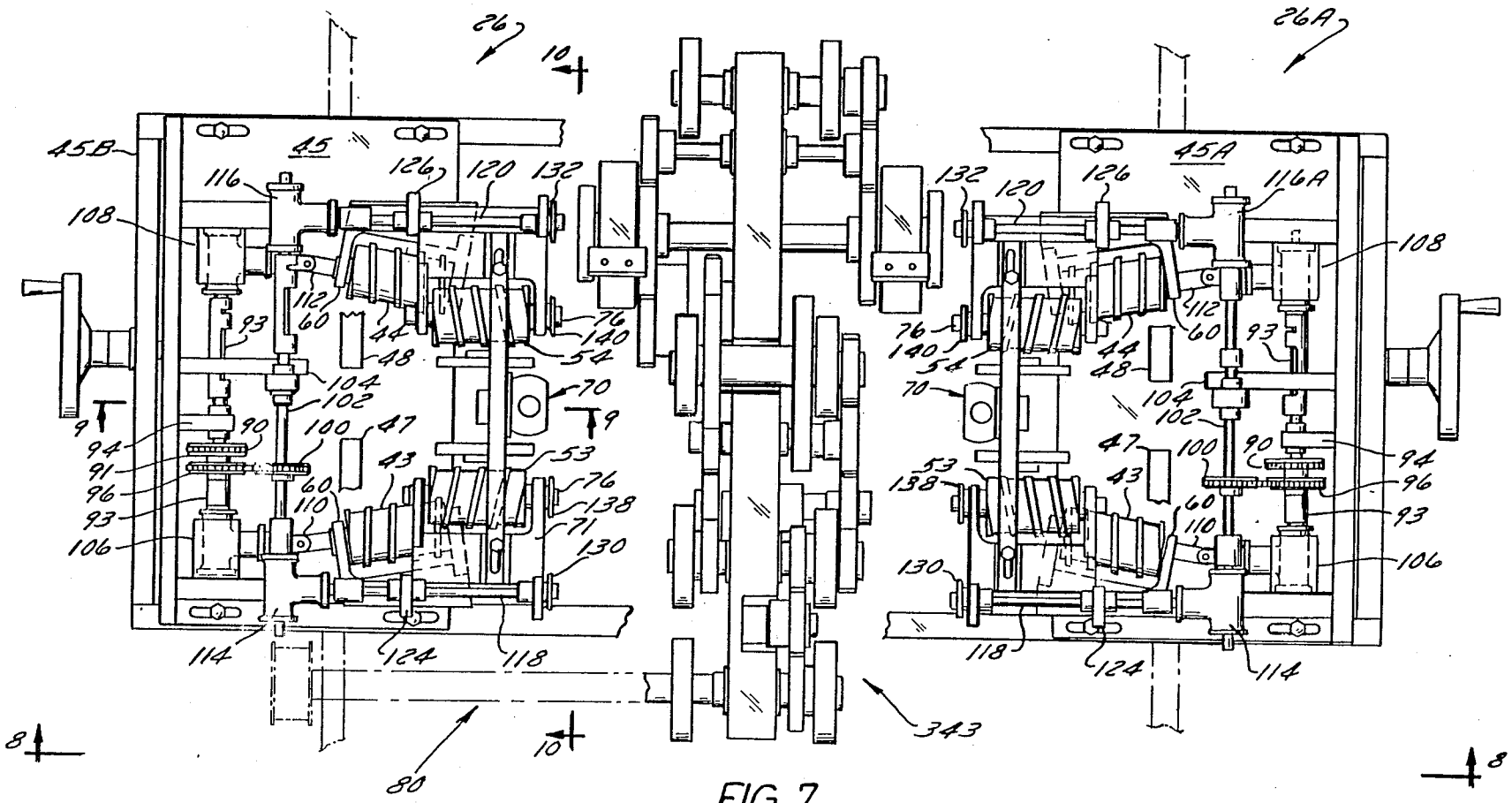
FIG. 7 is an enlarged top plan view of the two mechanisms, with upper portions removed to show interior details, and also shows a portion of the paperboard blank feeder unit.

Referring to FIGS. 7 through 10, the bottom screws 43 and 44 take the form of a pair of spaced apart, reversely-threaded, contra-rotating de-stacking screws 43 and 44 which are rotatably supported by guide means (brackets) such as 60 on support structure 45. As FIG. 9 best shows, each screw 43 and 44 comprises an elongated cylindrical body 62, a helical thread 64 integrally formed on the surface of body 62 and projecting outwardly therefrom, and cylindrical stub shafts 66 at opposite axial ends of body 62. The screw threads 64 on the de-stacking screws 43 and 44 are wound in opposite directions and the screws are rotatable in opposite directions to one another (see arrows D and E in FIG. 10). Each screw 43 and 44 is rotatably supported by its stub shafts 66 which are journalled in bearing assemblies (not visible) which are mounted on the guide means (brackets) 60 on support structure 45. As FIG. 9 makes clear, each screw 43 and 44 is disposed so that the upper side of its body 62 lies in the same plane as the underside of the lowermost rod 14 in magazine 41 and so that its thread 64 intersects that plane. Each screw 43 and 44 is mounted so that its rear end lies just beneath magazine 41. Thus, the underside of the lowermost rod 14 in magazine 41 rests on the upper side of body 62 of each of the screws 43 and 44 and ahead of the front edge of the thread 64 on the screws 43 and 44. As FIG. 9A shows, the rear end of the thread 64 on screw 44 diminishes in height and is also bevelled along the rear edge as at 67. Thread 64 on screw 43 is similarly constructed. The de-stacking screws 43 and 44 are arranged in horizontally spaced apart relationship with each other (in the direction of path P1). However, as FIGS. 6 and 7 show, their axes of rotation are not parallel to each other but converge inwardly toward each other when proceeding in a direction from the rear end to the front end of the screws. The angle of convergence is determined by or is a function of the pitch of the screw threads 64 on the screws 43 and 44. Screw thread pitch and angle of convergence are chosen so that, when a rod 14 is engaged by both screws 43 and 44, the rear edge of 14B of the rod 14 is substantially tangent to the front edge of the threads at the points which engage the threads. This arrangement enables a rod 14 to be engaged and advanced uniformly and smoothly by the de-stacking screws 43 and 44.

Top Screws

Referring to FIGS. 7 through 10, the top screws 53 and 54 take the form of a pair of spaced-apart, reversely-threaded, contra-rotating screws 53 and 54 which are rotatably supported by brackets such as 71 on support structure 45. Each screw 53 and 54 comprises an elongated cylindrical body 72, a helical thread 74 integrally formed on the surface of body 72 and projecting outwardly therefrom, and cylindrical stub shafts 76 at opposite axial ends of body 72. The screw threads 74 on the screws 53 and 54 are wound in opposite directions and the screws are rotatable in opposite directions to one another (see arrows F and G in FIG. 10). Each screw 53 and 54 is rotatably supported by its stub shafts 76 which are journalled in bearing assemblies (not visible) which are mounted on the brackets 71 on support structure 45. Each screw 53 and 54 is disposed so that the lower side of its body 72 lies in the same plane as the upper side of a rod 14 being advanced and so that its thread 74 intersects that plane. Each screw 53 and 54 is mounted so that its rear end lies just above the front end of the associated de-stacking screws 43 and 44. Thus, the rod 14 being advanced by the de-stacking screws 43 and 44 rests on the upper side of the body 62 of each of the de-stacking screws 43 and 44 and is engageable by the threads 74 of the top screws 53 and 54. The screws 53 and 54 are arranged in horizontally spaced apart relationship with each other (in the direction of path P1). However, their axes of rotation are parallel to each other. Screw thread pitch is chosen so that, when a rod 14 is engaged by the threads 74 of both screws 53 and 54, the rear edge of 14B of the rod 14 is substantially tangent to the front edge of the threads 74 at the points which engage the threads. This arrangement enables a rod 14 to be engaged and advanced uniformly and smoothly by the screws 53 and 54.

Means For Driving Screws

Referring to FIGS. 7 through 10, it is to be understood that the de-stacking screws 43 and 44 and the top screws 53 and 54 could be driven by an electric motor (not shown) mounted on support structure 45. However, in the interest of synchronization, simplicity and economy, it is preferable to drive the screws from a power transmission mechanism 80 (FIGS. 7, 8 and 10) which also supplies operating power to conveyor means 40 and to a mechanism 343 (FIGS. 7, 8 and 10) which effects momentary stoppage of a blank 12 adjacent and between the mechanisms 26 and 26A. The power transmission mechanism 80 and the mechanism 343 are both described in detail in aforementioned U.S. Pat. No. 4,238,273.

Figure 8:
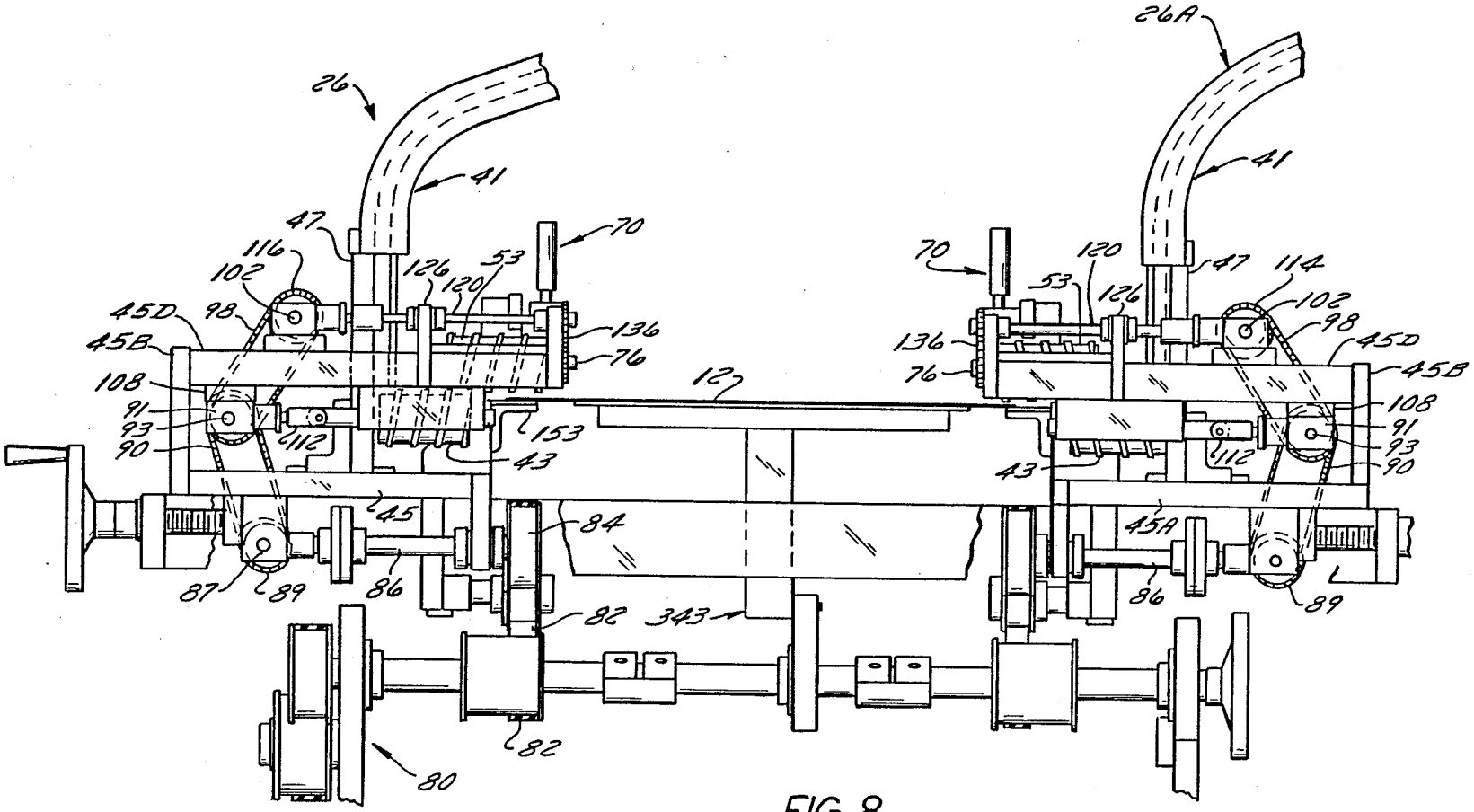
FIG. 8 is a side elevation view of the two mechanisms taken on line 8—8 of FIG. 7.

As FIG. 8 best shows, power transmission mechanism 80 comprises a rotatably driven endless flexible drive belt 82. Belt 82 is reeved around a pulley 84 affixed to a shaft 86 which is rotatably supported on support structure 45. Shaft 86 is connected to a main gear box 87 on support structure 45 and the gear box has a drive pulley 89 thereon which constantly rotates when the mechanism 26 is in operation.

Figures 9, 9A:
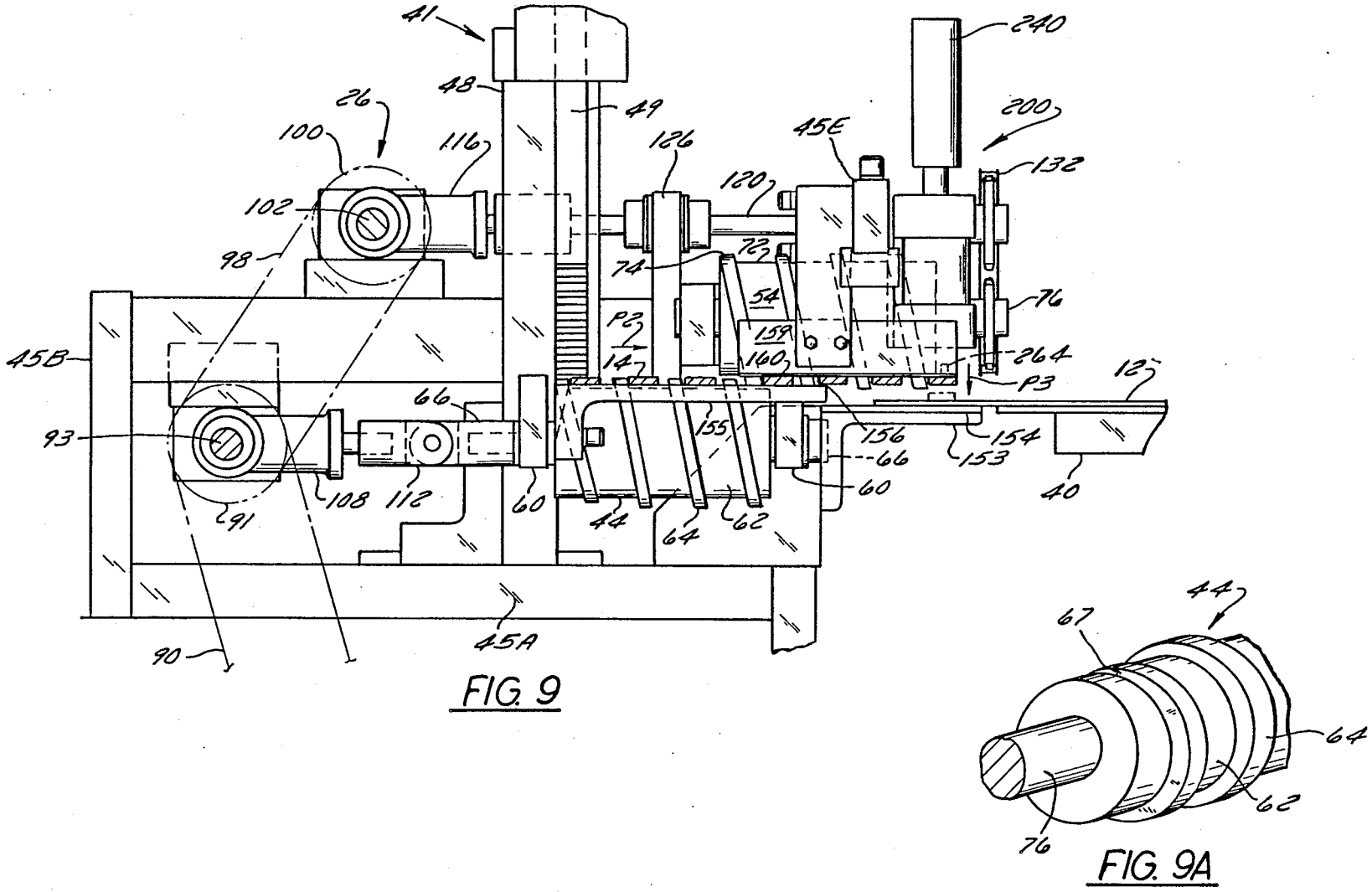
FIG. 9 is an enlarged side elevation view of one of the mechanisms taken on line 9—9 of FIG. 7.
FIG. 9A is an enlarged perspective view of one of the destacking screws.

Referring to FIGS. 7, 8 and 9, drive pulley 89 is connected by an endless flexible belt 90 to a driven pulley 91 which is affixed to and effects rotation of a first drive shaft 93 which is rotatably supported on support structure 45 as by a bracket 94. First drive shaft 93 effects rotation of the de-stacking screws 43 and 44, as hereinafter explained. First drive shaft 93 also has a drive pulley 96 (FIG. 7) affixed thereto and rotatable therewith which is connected by an endless flexible belt 98 (FIGS. 7, 8 and 9) to a driven pulley 100 which is affixed to and effects rotation of a second drive shaft 102. Second drive shaft 102 is rotatably supported on support structure 45 as by a bracket 104. Second drive shaft 102 effects rotation of the top screws 53 and 54, as hereinafter explained.

First drive shaft 93 has its opposite ends connected to the input shafts of right-angle gear boxes 106 and 108 which have their output shafts connected, through universal joints 110 and 112, respectively, to the stub shafts 66 at the rear ends of the de-stacking screws 43 and 44, respectively. The output shafts of the gear boxes 106 and 108 are understood to rotate in opposite directions (see arrows D and E in FIG. 10).

Second drive shaft 102 has its opposite ends connected to the input shafts of right-angle gear boxes 114 and 116 which have their output shafts connected to rotatably drive extension shafts 118 and 120, respectively, which are rotatably supported on support structure 45, as by brackets 124 and 126, respectively.

Extension shafts 118 and 120 are provided at their front ends (i.e., those ends closest to path P1 along which the blanks 12 are conveyed) with drive pulleys 130 and 132, respectively, which are affixed thereto and rotatable therewith. As FIG. 10 best shows, the drive pulleys 130 and 132 are connected by endless flexible belts 134 and 136, respectively. The belts 134 and 136 are reeved around driven pulleys 138 and 140, respectively, which are affixed to the stub shafts 76 at the front end of the top screws 53 and 54, respectively, and effect rotation thereof in the direction of the arrows F and G (FIG. 10), respectively.

Rod Guide Means

Referring to FIGS. 8 through 12, the rod guide means 60 for guiding a rod 14 as it is advanced along path P2 by the destacking screws 43 and 44 and by the top screws 53 and 54 will now be described. Generally considered, the rod guide means 60 comprises a pair of laterally spaced apart grooved guide members 150 and 152 (FIGS. 10, 11, 12) which extend forwardly from beneath magazine 41; a first pair of laterally spaced apart, elongated members 153 and 155 having upwardly facing magnetic surfaces 154 and 156, respectively, which extend forwardly from beneath the magazine and for the entire length of the destacking screws 43 and 44 and for about half the length of the top screws 53 and 54 (FIG. 9); and a second pair of laterally spaced apart, elongated members 157 and 159 having downwardly facing magnetic surfaces 158 and 160, respectively, which extend forwardly for substantially the entire length of the top screws 53 and 54 and slightly beyond the front ends thereof (FIG. 9).

As FIGS. 11 and 12 make clear, each rod guide member 150 and 152, which is supported on a side plate assembly 45D of support structure 45, is provided with a horizontal groove 149 is slightly greater than the thickness of the rod 14 and, preferably, is adjustable. The rear end of horizontal groove 149 registers with an opening 50 at the lower end of vertical groove 49 in the magazine 41.

Figure 10:
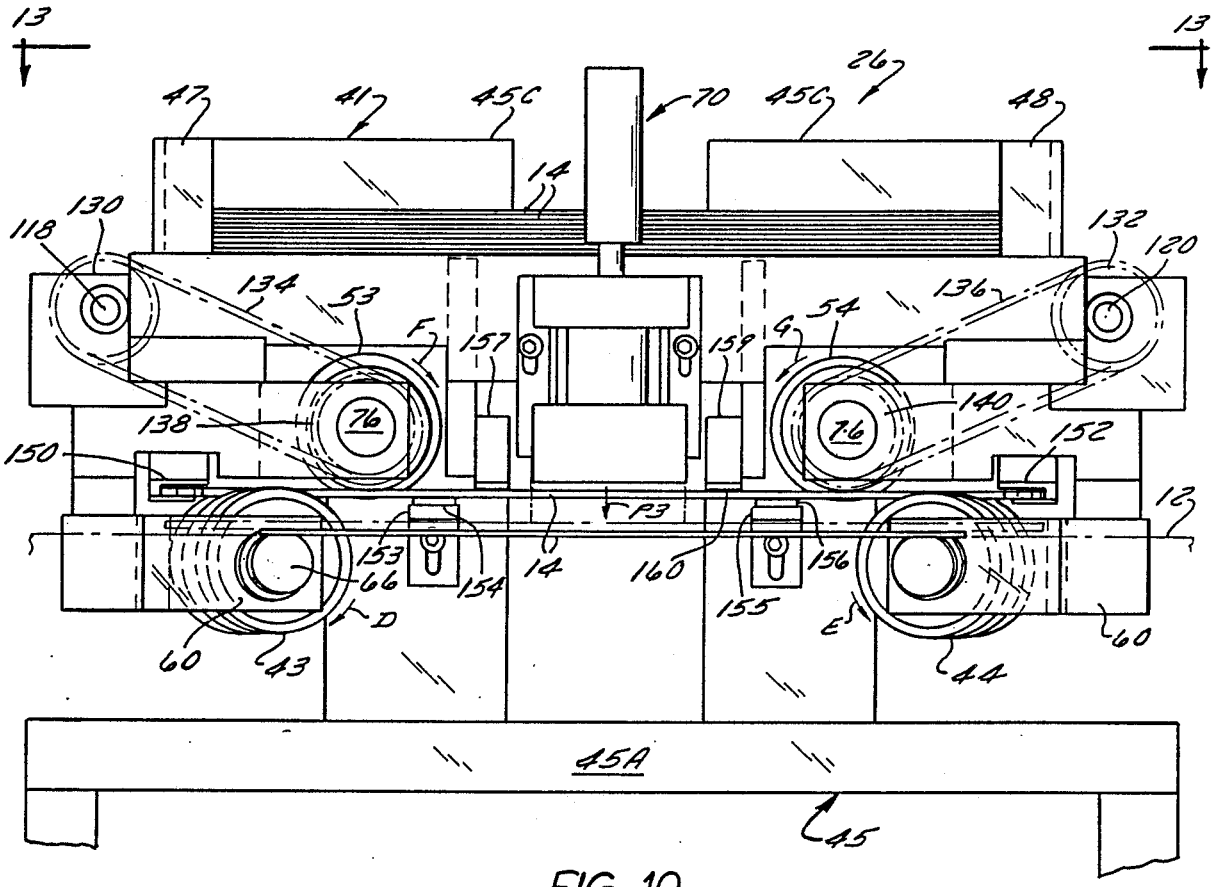
FIG. 10 is an enlarged front elevation view of one of the mechanisms taken on line 10—10 of FIG. 7.

As FIGS. 9 and 10 make clear, the elongated members 153 and 155 are adjustably but rigidly secured to and extend forwardly from the intermediate support plates 47 and 48, respectively, of support structure 45. The members 153 and 155 are provided on their upper sides with commercially available magnetic strips which define upwardly facing magnetic surfaces 154 and 156, respectively, to which each metal (steel) rod 14 is attracted and slidably adheres as soon as it is withdrawn from magazine 41 by the de-stacking screws 43 and 44. Such attraction is insufficient to prevent sliding advancing motion of the rod 14 by the de-stacking screws 43 and 44, but is sufficient, in cooperation with the rod guidance provided by the guide rails 150 and 152, to prevent the rod from vibrating or becoming disengaged from the de-stacking screw threads.

The elongated members 157 and 159 are rigidly secured to front support plate 45E of support structure 45 and are provided on their undersides with magnetic strips which define downwardly facing magnetic surfaces 158 and 160, respectively, to which each rod 14 is attracted and slidably adheres after it is disengaged from the threads of the de-stacking screws 43 and 44 and is being advanced by the top screws 53 and 54 so as to prevent the rod from falling. As FIG. 9 shows, the forwardmost ends of the magnetic surfaces 158 and 160 extend beyond the front ends of the grooves 149 in the guide members 150 and 152 and define the at-rest position of a rod 14 after it has been disengaged from the top screws 53 and 54. This arrangement allows the rod 14 to be moved downwardly along an unobstructed path P3 by the rod applicator means 70, as hereinafter described. The magnetic surfaces 158 and 160 also provide a stabilizing guidance function.

Rod Placement Means

Referring to FIGS. 9, 10, 13 and 14, there is shown the rod placement means 70 for moving a rod 14 downwardly along path P3 from its at-rest position into a specific location, namely, onto a glue pattern 24 on a stationary blank 12. The rod placement means 70 generally comprises a pneumatic actuator 200, a rod placement bar 202 reciprocably movable by the pneumatic actuator, holding means comprising a vacuum port 204 on the rod placement bar to releasably maintain the rod engaged with the rod placement bar, and a control means for operating the pneumatic actuator and the holding means.

Figure 13:
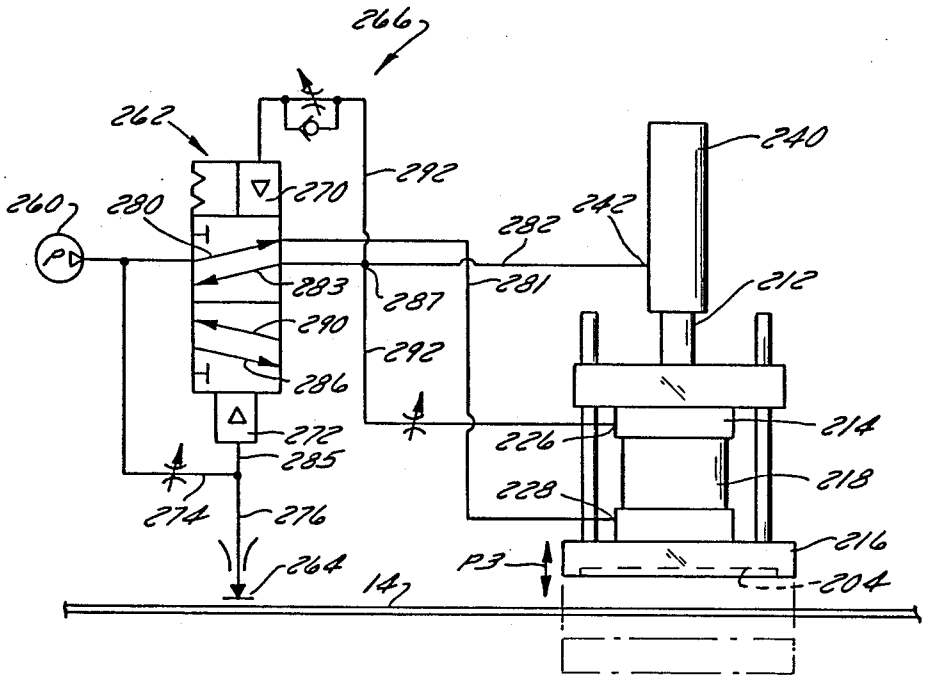
FIG. 13 is an enlarged front elevation view of a pneumatic rod placement unit shown in FIG. 9.
Figure 14:
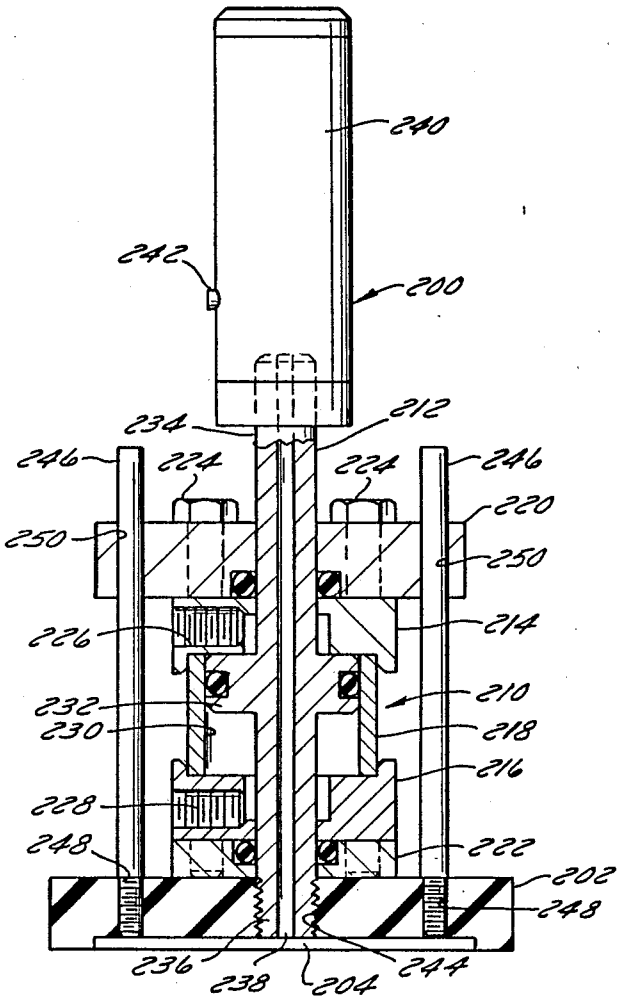
FIG. 14 is an enlarged cross-section view of the rod placement unit of FIG. 15.

Referring to FIGS. 13 and 14, pneumatic actuator 200 comprises a cylinder assembly 210 and a piston assembly 212 slidably mounted therein. Cylinder assembly 210 comprises an upper end plate 214, a lower end plate 216, and a hollow cylindrical tube 218 entrapped between the end plates. An upper base plate 220 is disposed on top of upper end plate 214 and a lower base plate 222 is disposed beneath lower end plate 216 and a pair of cap screws 224 are interconnected between the base plates 220 and 222 to secure the cylinder assembly 210 together. The upper end plate 214 and the lower end plate 216 are provided with ports 226 and 228, respectively, which communicate with opposite ends of a cylinder chamber 230 within cylinder assembly 210.

Piston assembly 210 comprises a piston 232 which is disposed within cylinder chamber 230 and is provided with an upwardly extending piston rod 234 and a downwardly extending piston rod 236. An air passage 238 extends through piston rod 34, piston 232 and piston rod 236. Upwardly extending piston rod 234 is secured to a hollow air injector device 240 having an air port 242 thereon and the upper end of air passage 238 communicates with the hollow interior of device 240. Air injector device 240 operates on the venturi principle in that, when port 242 is pressurized, passage 238 becomes vacuumized.

The rod placement bar 202 is fabricated of rubber or similarly flexible and resilient plastic material and has a threaded central hole 244 therethrough by which it is mechanically connected to the externally threaded lower end of piston rod 236. Rod placement bar 202 is provided on its underside with the vacuum port 204 which takes the form of an elongated narrow groove which is in communication with the lower end of air passage 238 in piston assembly 210. Port 204, when vacuumized as hereinafter explained, operates as a holding means to releasably hold a rod 14 against rod placement bar 202 as the rod is being moved thereby and the resiliency of the rod placement bar, which conforms to the rod shape, ensures an air-tight seal between rod 14 and the undersurface of rod placement bar 202. Rod placement bar 202 is provided near its outer ends with a pair of upwardly extending guide rods 246 which are threadedly secured thereto as at 248. The guide rods 246 are slidably engaged in holes 250 in upper base plate 220 and serve to guide and maintain the orientation of rod placement bar 202 as it is reciprocably moved along path P3 by piston assembly 210.

Referring to FIG. 13, the control means for operating pneumatic actuator 200 and the vacuum port 204 of the rod holding means generally comprises a source of compressed air, such as a pump 260, an air control valve 262, an air jet sensor 264 (see also FIG. 9), a downstroke timer valve 266, and the air injector device 240 hereinbefore referred to. Air control valve 262, which controls air flow to pneumatic actuator 200 and to air injector device 240, is a two-position valve which is normally biased by a spring 268 into the position shown in FIG. 13 and is controllable by upper and lower pilot valves 270 and 272. Air jet sensor 264 takes the form of an air port which is located, as shown in FIG. 9, in member 159 and the magnetic strip 160 thereon at the at-rest position of a rod 14.

When the mechanism 26 is in operation, compressed air is continually supplied directly from air pump 260 to control valve 262 and to jet sensor port 264.

If there is no rod 14 in the at-rest position, air is able to flow from pump 260, through line 274, through line 276, and to escape from jet sensor port 264 and control valve 262 assumes the position shown in FIG. 13. Air also flows from pump 260, through valve passage 280, through line 281 and through actuator port 228 into cylinder chamber 230 to maintain piston assembly 210 (and rod placement bar 202) upward. No air is being supplied to air injector device 240, which is connected to exhaust through port 242, line 282 and valve passage 283.

When a rod 14 reaches the at-rest position and blocks the escape of air from jet sensor port 264, air flows from pump 260, through lines 274 and 285 to lower pilot valve 272 of control valve 262, and the latter assumes its other position. Thus, air then flows from pump 260 and through valve passage 286 to connection point 287 from whence it flows simultaneously along three routes. First, air flows from point 287 through line 290 to actuator port 226 into cylinder chamber 230 to cause downward movement of piston assembly 210 (and rod placement bar 202). Simultaneously, air exhausts from the lower side of piston 232 through port 228, through line 290 and through valve passage 286 to atmosphere. Second, air flows from point 287 through line 282 to port 242 on air injector device 240, whereupon air passage 238 in piston assembly 210 and vacuum port 204 on placement bar 202 become vacuumized. Third, air flows from point 287 through line 292 and through timer valve 266 to upper pilot valve 270 for a preset interval of time to prevent control valve 262 from returning to the position shown in FIG. 13 when rod 14 is moved from the at-rest position and the air jet sensor port 264 is uncovered.

Operation

One complete cycle of operation of rod feeding and placement mechanism 26 will now be described. Assume that magazine 41 is filled with a stack of rods 14. Further, assume that all screws 43, 44, 53 and 54 are continuously rotating in the appropriate directions and that compressed air pump 260 is in operation. Also, assume that a blank 12 with a glue strip 24 thereon has been momentarily stopped adjacent mechanism 26.

As the bottom de-stacking screws 43 and 44 contrarotate, the threads 64 thereon engage the rear edge 14B of the lowermost rod 14 in magazine 41 and advance it along path P2; it being guided in the guide slots 149 in the guides 150 and by the upwardly facing magnetic strips 154 and 156 as it proceeds. Just prior to the rod 14 reaching the front (exit) end of the de-stacking screws 43 and 44, the threads 74 on the top screws 53 and 54 engage the rear edge 14B of the rod being advanced and advance it further along path P2; it still being guided and supported in the guide slots 149 but now also being guided and supported by the downwardly facing magnetic strips 157 and 159. When the rod 14 reaches the front (exit) end of the top screws 53 and 54 and leaves the exit ends of the guide slots 149, it is still seized and held by that portion of the magnetic strips 157 and 159 which define the at-rest position and prevent the rod from falling. When rod 14 is in the at-rest position, it blocks sensor port 264 to effect operation of rod placement means 70. The rod placement bar 202 descends from its starting position above the at-rest position, physically engages the rod 14 and forces it downwardly and free of the magnetic strips 157 and 159. However, upon contact with rod 14, the electro-vacuumized port 204 on rod placement bar 202 causes the freed rod to adhere to the placement bar and prevents it from falling. The rod placement bar 202 descends along path P3 and forces the rod 14 thereon against the glue strip 24 on blank 12. Then, the port 204 becomes de-vacuumized to prevent the rod 14 from being raised from the glue strip as the rod placement bar 202 is raised upward back to its starting position.

The foregoing cycle is repeated as long as the mechanism is in operation. As will be understood, during operation, since the screws 43, 44, 53 and 54 are continuously rotating, a plurality of rods 14 will be advancing simultaneously along path P2.

We claim:

1. A mechanism for feeding and placing a rod in a specific location comprising:

means for supporting a plurality of elongated rods in a stack;

a first screw means comprising a pair of screws for releasably engaging the endmost rod at one end of said stack and for advancing it laterally along a rod path to a second screw means comprising a second pair of screws located on the opposite side of the rod path to further advance and release it at an at-rest position spaced from said specific location;

guide means for supporting a rod being advanced toward said at-rest position by said screw means;

means for releasably maintaining a rod in said at-rest position;

and rod placement means for moving a rod from said at-rest position to said specific location.

2. A mechanism according to claim 1 wherein said de-stacking screw comprises a rotatable body having an axis of rotation and a helical thread around said body, and wherein the axis of rotation of said de-stacking screw is disposed so that the helical thread thereon tangentially engages a rod being advanced by said de-stacking screw.

3. A mechanism according to claim 1 wherein said rod is magnetizable and wherein said guide means comprises magnetic means.

4. A mechanism according to claim 1 wherein said rod is magnetizable and wherein said means for releasably maintaining a rod in said at-rest position comprises magnetic means near said at rest position.

5. A mechanism according to claim 1 wherein said rod placement means for moving a rod from said at-rest position to said specific location comprises a movable component having a vacuum port for releasably engaging a rod being moved by said movable component.

6. A mechanism for feeding and placing a rod in a specific location comprising:

means for supporting a plurality of rods in a stack;

screw means for releasably engaging the endmost rod at one end of said stack and for advancing it laterally along a rod path to and releasing it at an at-rest position spaced from said specific location, said screw means comprising a pair of contra-rotatable de-stacking screws extending from near said one end of said stack toward said at-rest position and rotatable to engage the endmost rod at one end of said stack, to advance it along said rod-path toward said at-rest position and to release it;

said screw means further comprising a second pair of contra-rotatable screws located on the opposite side of the rod path extending from said pair of de-stacking screws toward said at-rest position and rotatable to engage a rod being advanced by said de-stacking screws and to further advance it along said rod-path to said at-rest position;

each of said screws comprising a cylindrical body having an axis of rotation and a helical thread around said body, and wherein the axes of rotation of said pair of de-stacking screws converge when proceeding in the direction from said stack toward said at-rest position so that the helical threads thereon tangentially engage a rod being advanced by said pair of de-stacking screws;

guide means for supporting a rod being advanced toward said at-rest position by said screw means;

means for releasably maintaining a rod in said at-rest position;

and rod placement means for moving a rod from said at-rest position to said specific location.

7. A mechanism according to claim 6 wherein said rod is magnetizable, wherein said guide means comprises magnetic means and wherein said means for releasably maintaining said rod in said at-rest position comprises magnetic means near said at-rest position.

8. A mechanism according to claim 6 or 7 wherein said rod placement means for moving said rod from said at-rest position to said specific location comprises a movable component having a vacuum port for releasably engaging a rod being moved by said movable component.

9. A mechanism according to claim 8 wherein said movable component is reciprocably movable between said at-rest position and said specific location.

10. A mechanism for feeding and placing a rod in a specific location comprising:

means for supporting a plurality of elongated rods in a stack;

a first screw means comprising a pair of screws for releasably engaging the endmost rod at one end of said stack and for advancing it laterally along a rod path to a second screw means comprising a second pair of screws located on the opposite side of the rod path to further advance and release it at an at-rest position spaced from said specific location;

guide means for supporting a rod being advanced toward said at-rest position by said screw means;

means for releasably maintaining a rod in said at-rest position;

and rod placement means for moving a rod from said at-rest position to said specific location, said rod placement means comprising:

a reciprocably movable component for engaging said rod;

actuator means operable to effect reciprocating movement of said movable component;

control means for effecting operation of said actuator means and comprising sensor means responsive to arrival and departure of a rod at said at-rest position;

and means for releasably maintaining a rod on said reciprocably movable component while the rod is being moved toward said specific location.

11. A mechanism according to claim 10 wherein said actuator means comprises a pneumatic actuator; wherein said sensor means comprises an air port near said at-rest position; and wherein said means for releasably maintaining a rod on said movable component comprises a vacuum port.

12. A rod feeding and placement mechanism for use in apparatus for making hanging file folders to place a rod on a glue pattern on a paperboard blank, said mechanism comprising:

a magazine for supporting a plurality of elongated rods in a vertical stack;

a first screw means comprising a pair of screws means for releasably engaging the lowermost rod in said stack and for advancing it laterally along a rod-path to a second screw means comprising a second pair of screws located on the opposite side of the rod path to further advance and release it at an at-rest position above said glue pattern on said paperboard blank;

guide means for supporting a rod being advanced along said rod-path;

means for releasably maintaining a rod in said at-rest position;

and rod placement means for moving a rod downwardly from said at-rest position and onto said glue pattern and for releasing the rod thereat.

13. A mechanism according to claim 12 wherein said screw means comprises:

a pair of contra-rotatable de-stacking screws extending from below said magazine and along said rod-path;

and a pair of contra-rotatable top screws extending from above said pair of de-stacking screws and along said rod-path to said at-rest position.

14. A mechanism according to claim 12 or 13 wherein said guide means comprises a pair of slotted guide rails-extending along said rod-path and having slots for slidably receiving the ends of a rod.

15. A mechanism according to claim 14 wherein said guide means further comprises: an elongated upwardly facing magnetic surface extending along said rod-path approximately for the length of said de-stacking screws; and a downwardly facing magnetic surface extending along said rod-path for the length of said top screws.

16. A mechanism according to claim 15 wherein said means for releasably maintaining a rod in said at-rest position comprises a portion of said downwardly facing magnetic surface.

17. A mechanism according to claim 12 or 13 wherein, said rod placement means comprises:

a reciprocably movable component for engaging said rod;

actuator means operable to effect reciprocating movement of said movable component;

control means for effecting operation of said actuator means and comprising sensor means responsive to arrival and departure of a rod at said at-rest position;

and means for releasably maintaining a rod on said reciprocably movable component while the rod is being moved toward said specific location.

18. A mechanism according to claim 17 wherein said actuator means comprises a pneumatic actuator; wherein said sensor means comprises an air port near said at-rest position; and wherein said means for releasably maintaining a rod on said movable component comprises a vacuum port.

* * * * *